US005443599A

United States Patent [19]

Bechtold et al.

[11] Patent Number: 5,443,599

[45] Date of Patent: Aug. 22, 1995

[54] PROCESS FOR REDUCTION OF TEXTILE DYESTUFFS

[75] Inventors: Thomas Bechtold; Eduard Burtscher, both of Dornbirn, Austria

[73] Assignee: Verein zur Forderung der Forschung und Entwicklung in der Textilwirtschaft, Feldkirch, Austria

[21] Appl. No.: 358,689

[22] Filed: Dec. 19, 1994

Related U.S. Application Data

[63] Continuation of Ser. No. 916;150, filed as PCT/AT91/00123, Dec. 2, 1991, abandoned.

[30] Foreign Application Priority Data

Dec. 3, 1990 [AT] Austria ..... 2436/90

[51] Int. Cl.[6] ..... C07B 31/00

[52] U.S. Cl. ..... 8/623; 8/528; 8/598; 8/604; 8/650; 8/662

[58] Field of Search ..... 8/461, 465, 528, 618, 8/623, 604, 598, 650, 662; 252/188.1

[56] References Cited

U.S. PATENT DOCUMENTS

| | | | |
|---|---|---|---|
| 1,774,940 | 9/1929 | Mengel | 8/623 |
| 2,069,919 | 2/1937 | Hardacre et al. | 8/623 |
| 2,843,580 | 7/1958 | Straley | 8/623 |
| 2,906,587 | 9/1959 | Lantz | 8/623 |
| 2,923,592 | 2/1960 | Crosland | 8/623 |
| 3,086,004 | 4/1963 | Gross et al. | 8/623 |
| 3,096,319 | 7/1963 | Dreyer et al. | 8/623 |
| 5,244,549 | 9/1993 | Bechtold | 204/134 |

OTHER PUBLICATIONS

Hackh's Chemical Dictionary, 4th Edition, McGraw-Hill Book Company, 1972, p. 26.

Bechtold et al., "Textileveredlung", vol. 25, No. 6, pp. 221-226 (Jun. 1990).

*Primary Examiner*—Paul Lieberman

*Assistant Examiner*—Caroline L. Dusheck

*Attorney, Agent, or Firm*—Wenderoth, Lind & Ponack

[57] ABSTRACT

A process comprising the reduction of textile dyestuffs in an aqueous alkaline medium by means of a reducing compound which is a complex of an organic complexing agent and an iron (II)-salt. The iron (II)-salt is present in an amount sufficient to ensure the desired reduction of the dyestuff after a single oxidation.

10 Claims, No Drawings

PROCESS FOR REDUCTION OF TEXTILE DYESTUFFS

This application is a continuation of now abandoned application, Ser. No. 07/916,150 filed Jul. 31, 1992, which is the national phase of international application PCT/AT 91/00123 filed Dec. 2, 1991.

In textile refining treatment vat, sulfur and indigo dyestuffs have a considerable market share as those dyestuffs belong in qualitative terms to the highest-grade types of dyestuffs for dying cellulose fibers. A common factor with all three classes of dyestuffs is that in use the dyestuffs which usually occur in the insoluble oxidized form are converted by a reduction .step into the lye-soluble reduced form. The reduced dyestuff molecules have a high level of affinity for the fiber material and therefore cling on to the fibers. Complete fixing of the dyestuffs on the fiber is then effected by oxidation of the dyestuff molecules which thereby again become insoluble.

A very wide range of operating procedures are used in a technical context or described in the literature, for the purposes of putting the dyestuff molecules into the reduced form.

The chemical which is most frequently used at the present time for reduction of the dyestuff molecules in the lye-bearing dye bath is sodium dithionite ($Na_2S_2O_4$). That compound permits the attainment of relatively high reduction potentials in the dye bath (about −1000 mV). A disadvantage in that respect is the severe temperature dependency of the redox potential, which particularly at high temperatures can result in dye over-reduction with undesired irreversible colour shade changes. In addition, a difficulty when using sodium dithionite is the lack of resistance of the chemical in alkaline treatment baths. Even in the absence of oxygen from the air, slow spontaneous decomposition occurs, which, particularly when using corresponding printing pastes in textile printing, renders storage thereof and therewith also universal use impossible. Among the reducing agents which are known at the present time, sodium dithionite belongs to the reducing agents with a comparatively high reducing rate, which means in specific terms that, in most cases, dyestuff reduction has taken place completely after a few minutes at ambient temperature. At higher temperatures dyestuff reduction takes place more quickly but on the other hand the rate of spontaneous decomposition also increases.

Formaldehyde sulfoxylates have a higher level of stability in relation to oxygen from the air, which can be explained by the overall lower degree of reactivity of such compounds.

Under suitable temperature-concentration conditions, it is possible to achieve sufficiently high reduction potentials (about −1100 mV) with the reducing agents of this class. However the specified compounds require relatively high temperatures (from about 90° C.) in order to permit a sufficient rate to be achieved in the dyestuff reduction operation. The reducing agents are frequently used in textile printing pastes as that provides adequate storage stability for the pastes. The reduction rate of those classes of compounds is to be assessed as being very low, at ambient temperature. Therefore, the use of metal complex catalysts has been the subject of extensive investigation, in order to accelerate the dyestuff reduction effect. With that mode of operation, the reducing agent can be activated by the addition of a small amount of a metal complex (in particular nickel or cobalt complexes). In regard to a cobalt complex (pentacyanocobalt (II)-complex), it is stated that it is possible that this compound is also capable of acting as a reducing agent if suitably large amounts are employed. In that respect, technical use is not to be considered for reasons of toxicity and the resulting effluent or waste water problems. In this connection, various iron complexes have also been the subject of investigation, in regard to their catalytic effectiveness. The accelerating effect of iron salts on the reducing action of formaldehyde sulfoxylates was in part confirmed in such investigations. Overall however only a few iron complexes were described, which on the one hand enjoy sufficient lye stability and which on the other hand also exhibit catalytic effectiveness in regard to formaldehyde sulfoxylates. There are no references to the possible use of lye-soluble iron (II) complexes as reducing agents for dyestuff vatting.

Thiourea dioxide basically behaves from the chemical point of view in a similar fashion to the above-described reducing agents.

Various organic reducing agents are also used for the purposes of dyestuff reduction. A disadvantage in that respect is the low reduction potential that can be achieved (hydroxyacetone about −800 mV) which restricts the suitability for use to classes of dyestuffs with a low reduction potential (sulfur and indigo dyestuffs). The rate of dyestuff reduction is without exception less than that when using the above-mentioned reducing agents.

The iron (II) sulfate-soda lye-reducing procedure is now only of historical significance, but is worthy of note in connection with the invention. A disadvantage with that reduction technology is the fact that homogeneous reduction conditions are not possible as both the iron (II) hydroxide which occurs in the lye and also the iron (III) hydroxide which occurs due to oxidation are substantially insoluble in the lye. That formation of deposits is unacceptable in regard to the production of dyed textiles, having regard to modern production processes. Relatively large amounts of dyestuff are removed from the dye bath by virtue of the deposits, and that results in defective reproducibility of the dying effects, high dyestuff costs and difficulties in regard to effluent or waste water treatment.

The use of iron (II) sulfate and lime for reductive waste water decolorisation is also known in the literature. That procedure however also does not provide for homogeneous reaction conditions.

It is known from an article in the journal TEXTIL-VEREDLUNG 25 (1990) No 6, pages 221–226, by T Bechtold, E Burtscher, D Gmeiner and O Bobleter, that complex compounds comprising an iron salt and triethanolamine as complexing agents in an NaOH-alkaline solution are homogeneously soluble both in the bivalent reduced form of the iron and also in the trivalent oxidised form. In accordance with the above-mentioned prior publication, the iron salt is added in the iron (III)-form in a relatively small amount and continuously cathodically reduced in order in the subsequent return to the oxidised trivalent condition firstly to reduce the oxygen in the air, which is contained in the solution, and then the dyestuff. In each case therefore, as long as oxygen or non-reduced dyestuff molecules are in solution, only that small proportion of the complex compound which has just been charged up in the cathode and which has not yet reacted with substances of lower redox potential is in the reduced condition. The advantage of the known process is that only small amounts of complex compound have to be used as the compound only acts as a mediator which provides for charge transfer from the cathode on to the dyestuff, but is not itself consumed. That also applies in the case of the fourth example of use, which is not the subject of a prior description, of application PCT/AT 90/00052 (WO 90/15182). Admittedly, per se provision is made therein for the supply of the iron salt in the form of iron (II)-sulfate, but in such a small amount that it is already oxidised by the air oxygen present in the solution. In reduction of the dyestuff, the complex compound once again exclusively performs the function of a mediator, as described in the quoted prior publication.

All known reducing agents for textile dyestuffs which are suitable for practice suffer from the disadvantage that their reduction rate is very low at room temperature. Even the reduction of textile dyestuffs using a complex compound comprising an iron salt and triethanolamine in the manner described in the journal TEXTILVEREDLUNG at the quoted part therein lasts at least 30 minutes. It was therefore totally surprising that the underlying object of the present invention, namely finding a reducing agent which reacts quickly at room temperature and which has a high level of storage stability and which is homogeneously soluble both in the reduced and in the oxidised condition, can be attained in that the per se known complex compound is provided not as a mediator but directly as a reducing agent. The invention is thus characterised in that iron (II)-salt is used in such an amount that the single oxidation thereof is sufficient for the desired reduction of the dyestuff.

A requirement for carrying out a dyestuff reduction step, in accordance with the invention, by a metal complex salt with a low valency level is finding complexing agents which, besides the required stability, also permit an adequate level of reduction potential in respect of the iron (II)-complex. In accordance with the invention, the use of suitable complexing agents makes it possible to achieve sufficiently high levels of concentration of metal ions with a reducing action, in solution. In that respect, both the reduced and the oxidised form of the metal complex remain homogeneously dissolved in the treatment solution. In contrast to the known iron (II) salt-soda lye-vat, it is possible to avoid troublesome precipitation phenomena. The reduction rates which can be achieved when using such a reducing agent are unexpectedly high. It is now possible to achieve complete dyestuff reduction in a speed of seconds, in contrast to the reduction rates of the conventional reducing agents. That is of particular interest especially in regard to possible use in vat-etching-printing as due to the rapid dyestuff reduction effect it is possible if necessary even to omit a steaming process for dyestuff reduction. New aspects arise in relation to vat dying (continuously or discontinuously), due to the very high reduction rate. Thus, the passage of oxygen into the dye bath results in undesired dyestuff oxidation, with conventional reducing agents, as reduction of the dyestuff by the reducing agent takes place more slowly than air oxidation of the dyestuff. That is one of the causes of undesired inequalities of coloration in the dyed article. When using reducing agents which act correspondingly quickly, that undesired air oxidation effect can be extensively eliminated. When using the conventional reducing agents, that dyestuff oxidation is partly avoided by using large chemical surplusses, which however gives rise to consequential problems due to the excess of chemical materials. Due to the high level of stability of the metal complexes discovered, there is no spontaneous decomposition in the dye liquor or in the printing paste, which is a consideration of major significance in regard to the durability of the chemicals with a reducing action.

A further advantage is the possibility of controlling the reducing action of the metal complexes (reducing potential) by virtue of the selection of the complexing agent. That permits adaptation to the respective optimum requirements in terms of operating procedure. Conventional reducing agents do not permit such optimization effects to a comparable degree.

Besides the mode of operation which can be satisfactorily controlled in regard to the operating procedure involved, the use of such reducing agent systems also permits simple monitoring by a measuring procedure as the content of reducing species can be well detected by potential measurement, which is in no way the case with the conventional reducing agents. Suitable metal complex systems for dyestuff reduction are for example iron (II)-salts with organic complexing agents such as triethanolamine or citric acid (attainable reduction potentials in alkaline medium about −1000 mV). Other metal complexes can also be suitable for that purpose if the metal complex compound used can in alkaline solution generate a reduction potential which is above the respective reduction potential of the dyestuff employed.

In this respect, depending on the operating procedure involved, the amounts of metal complex required are so high that sufficient stability in regard to the reduction condition of the bath is guaranteed during the treatment time. Those levels of concentration are at the lowest in extraction dying. In that respect, when using an electrochemically monovalent metal ion (for example iron (II)-salts), levels of concentration of 0.01 mol/l are required, and then the required concentration of triethanolamine is around 0.1 mol/l. After optimization in terms of operating procedure however smaller amounts are also possible. With continuous dying processes and textile printing procedures, higher levels of concentration of reducing agent are required, in which respect the amount to be used varies depending on the method step and the installation design.

EXAMPLES OF USE

The described test Examples show possibilities in regard to use of the metal complex reducing agent for printing processes with vat dyestuffs. These Examples confirm the applicability thereof in various forms of operating procedure.

Example of Use 1

Direct Printing

The cotton fabric which was pre-treated in accordance with conventional processes is printed upon using a paste of the following composition:

0.69 g $FeSO_4.7H_2O$
2.77 g $H_2O$
2.77 g triethanolamine
1.85 g lye (400 g/l NaOH)
1.73 g thickening agent
0.173 g indanthrene blue GC.

After the paste has been applied, residence for several minutes at ambient temperature is sufficient to fix the dyestuff. Acceleration of the fixing effect can be achieved by an increase in temperature. That is usually already effected in the operation of drying the item, which follows the printing process. There is no need for a steaming process, as cannot be avoided when using conventional reducing agents for dyestuff fixing purposes.

The printed item can now be finished by washing out and boiling soaping, in accordance with the usual procedures.

Example of Use 2

Vat Etching Printing

When the article is dyed with dyestuffs which can be irreversibly decolorised by a reducing agent effect, a vat-etching-printing operation can be carried out with an article of that kind. The article is printed upon using a printing paste of the following composition:

0.69 g $FeSO_4.7H_2O$
2.75 g $H_2O$
3.18 g triethanolamine
1.14 g lye (400 g/l NaOH)
2.06 g thickening agent
0.17 g indanthrene brilliant green GG Fixing of the dyestuff present in the printing thickening is effected by residence at ambient temperature, at the same time the azo dyestuff which was applied to the article in the preceding dyeing process is reductively irreversibly decolorised. Acceleration of the reduction operations is possible by an increase in temperature.

The printed article can now be finished by washing out and boiling soaping, in accordance with the usual procedures.

Example of Use 3

Direct Printing with Subsequent Reduction

The cotton fabric which is pretreated in the usual way is printed upon, using a paste of the following composition:

3.0 g thickening
7.0 g $H_2O$
0.083 indanthrene red FBB

After the operation of drying the printed article, reduction of the dyestuff is effected by immersion in a bath of the following composition and subsequent squeezing-out:

20 g/l $FeSO_4.7H_2O$
82.6 g/l triethanolamine
50 ml/l soda lye (400 g/l NaOH)

Development already occurs at ambient temperature. After residence of the article at ambient temperature (a few minutes), the article is washed and finished in accordance with the usual procedures.

We claim:

1. A process for the reduction of textile dyestuffs comprising the step of mixing (i) a textile dyestuff selected from the group consisting of vat dyestuffs, sulfur dyestuffs, indigo dyestuffs and azo dyestuffs, (ii) a reducing compound which is a complex of an organic complexing agent and an iron (II)-salt, (iii) water and (iv) an alkalinity source, such that the resultant mixture has an alkaline pH level, wherein the iron (II)-salt is present in an amount such that oxidation of said iron (II)-salt to an iron (III)-salt generates a reduction potential sufficient to reduce the dyestuff.

2. A process as set forth in claim 1 characterised in that the iron (II)-salt is iron sulfate.

3. A process as set forth in claim 1 characterised in that triethanolamine is the organic complexing agent.

4. A process as set forth in claim 1 characterised in that citric acid is the organic complexing agent.

5. A process as set forth in claim 2 characterised in that triethanolamine is the organic complexing agent.

6. A process as set forth in claim 2 characterised in that citric acid is the organic complexing agent.

7. A process as set forth in claim 1 characterised in that said resulting mixture is a printing paste for printing on textiles.

8. A process as set forth in claim 2 characterised in that said resultant mixture is a printing paste for printing on textiles.

9. A process as set forth in claim 3 characterised in that said resultant mixture is a printing paste for printing on textiles.

10. A process as set forth in claim 4 characterised in that said resultant mixture is a printing paste for printing on textiles.

* * * * *